United States Patent [19]

Sakamoto et al.

[11] Patent Number: 4,784,618

[45] Date of Patent: Nov. 15, 1988

[54] FILTER CONNECTOR DEVICE

[75] Inventors: Yukio Sakamoto; Toshio Hori; Yasuo Fujiki, all of Nagaokakyo, Japan

[73] Assignee: Murata Manufacturing Co., Ltd., Japan

[21] Appl. No.: 45,607

[22] Filed: May 1, 1987

[30] Foreign Application Priority Data

May 8, 1986 [JP] Japan ..... 61-69481[U]

[51] Int. Cl.[4] ..... H01R 13/66

[52] U.S. Cl. ..... 439/620; 333/182

[58] Field of Search ..... 439/608, 609, 620, 607, 439/610; 333/181-185; 336/233

[56] References Cited

U.S. PATENT DOCUMENTS

| | | | |
|---|---|---|---|
| 2,940,058 | 6/1960 | Foster | 333/182 |
| 3,742,420 | 6/1973 | Harnden, Jr. | 361/56 |
| 3,743,996 | 7/1973 | Harnden, Jr. | 361/56 |
| 4,020,430 | 4/1977 | Vander Heyden | 439/608 |
| 4,374,369 | 2/1983 | Sakamoto et al. | 333/182 |
| 4,407,552 | 10/1983 | Watanabe et al. | 439/620 |
| 4,516,815 | 5/1985 | Venable et al. | 439/620 |
| 4,518,209 | 5/1985 | Negley | 439/609 |
| 4,659,163 | 4/1987 | Althouse et al. | 439/620 |
| 4,729,743 | 3/1988 | Farrar et al. | 439/620 |

*Primary Examiner*—Gil Weidenfeld
*Assistant Examiner*—Gary F. Paumen
*Attorney, Agent, or Firm*—Ostrolenk, Faber, Gerb & Soffen

[57] ABSTRACT

A filter connector device formed by combination of a male connector and a female connector. When the male connector and the female connector are engaged with each other, male connector pins and female connector pins are connected with each other. A filter circuit is formed by a plurality of elements including at least one capacitor and at least one inductor in cooperation with each pair of male and female connector pins thus connected in series with each other, and the plurality of elements forming such a filter circuit are dividedly provided in the male connector and the female connector.

13 Claims, 4 Drawing Sheets

FILTER CONNECTOR DEVICE

BACKGROUND OF THE INVENTION

1. Field of the Invention

The present invention relates to a filter connector device which is formed by combination of a male connector and a female connector engaged with the same, and more particularly, it relates to an improvement in the noise removing effectiveness of a filter circuit incorporated in such a filter connector device.

2. Description of the Prior Art

FIG. 18 shows an example of a conventional filter connector device. This filter connector device is formed by combination of a male connector 1 and a female connector 2 engaged with the same. The respective connectors 1 and 2 have connector housings 3 and 4, and pluralities of connector pins 5 and 6 are provided to pass through the connector housings 3 and 4 respectively. The connector pins 6 of the female connector 2 are provided in inward end portions thereof with clips for receiving the connector pins 5 of the male connector 1. A chassis 7 is provided to enclose the connector housing 3 of the male connector 1, and feedthrough capacitors 8 of which the pins 5 are the conductors are ground-connected to the chassis 7 so that the connector pins 5 serve as through conductors.

In the filter connector device as shown in FIG. 18, the male connector 1 is engaged with the female connector 2 to connect each pair of connector pins 5 and 6, thereby to form a filter circuit of a single capacitor as shown in FIG. 19.

The aforementioned filter connector device can be provided at a relatively low cost since the filter circuits can be formed by simply assembling the feedthrough capacitors 8 in the male connector 1.

However, such a filter connector device has only a single-capacitor 8 in relation to each series connection of connector pins 5 and 6 which are connected with each other, whereby a sufficient insertion loss characteristic may not be obtained when the same is applied to an electronic device (electronic circuit) having difference in input/output impedance.

To solve the aforementioned problem, filter circuits of high performance such as $\pi$-type filter circuits may be assembled in the male connector, for example. However, the complicated assembly of such means leads to a significant increase in cost.

SUMMARY OF THE INVENTION

Accordingly, an object of the present invention is to provide a filter connector device which is excellent in insertion less characteristic and has a high noise removing effect at a relatively low cost.

Provided according to the present invention is a filter connector device which is formed by combination of a male connector and a female connector engaged with the same. The male and female connectors respectively have a male connector pin and a female connector pin which are connected with each other, and the aforementioned problem is solved as follows:

A plurality of elements for forming filter circuits are dividedly provided in (distributed between) the male connector and the female connector so that a plurality of elements including at least one capacitor and at least one inductor form a filter circuit in cooperation with a series of male and female connector pins which are connected with each other upon engagement of the male and female connectors.

According to the present invention, a filter circuit having at least one capacitor and at least one inductor is formed in cooperation with a series of connector pins which are connected with each other when the male connector is engaged with the female connector (i.e., when the filter connector device is actually used). The filter circuit includes at least one capacitor and at least one inductor, and is capable of forming a filter circuit of high performance such as a $\pi$-type, T-type or L-type filter circuit. Thus, a higher insertion loss characteristic can be obtained in comparison with a filter circuit which includes only a single capacitor or inductor, and the noise removing effect is improved.

Further, the plurality of elements for forming filter circuits can be dividedly assembled in the male and female connectors, whereby the male and female connectors are each simplified in structure and thereby may be provided at a relatively low cost.

Various types of male and female connectors, including filter elements having different types or characteristics may be prepared, so that it will be possible to appropriately select and combine the male and female connectors in response to actual service conditions. In other words, the circuit structure of $\pi$-type, T-type or L-type filters can be readily varied at will and the optimum combination of the male and female connectors can be easily selected, on the basis of the impedance of a circuit to which such a filter connector device is to be applied.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
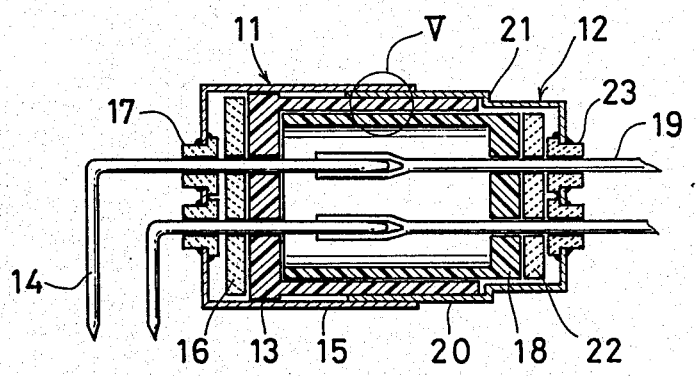
FIG. 1 is a longitudinal sectional view showing a filter connector device according to an embodiment of the present invention.
Figure 2:
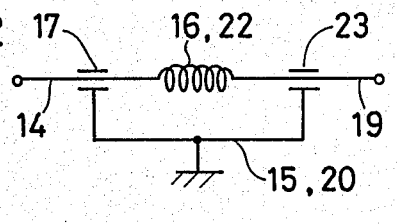
FIG. 2 illustrates a $\pi$-type filter circuit which is implemented by the filter connector device as shown in FIG. 1.
Figure 3:
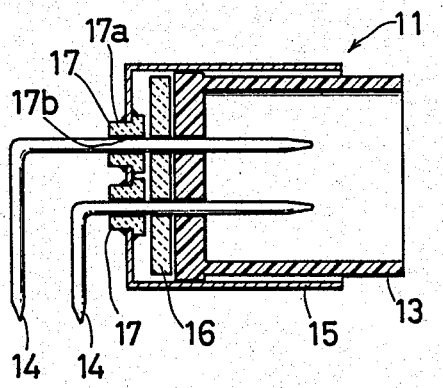
FIG. 3 is a longitudinal sectional view showing the male connector 11 forming a part of the filter connector device as shown in FIG. 1.
Figure 4:
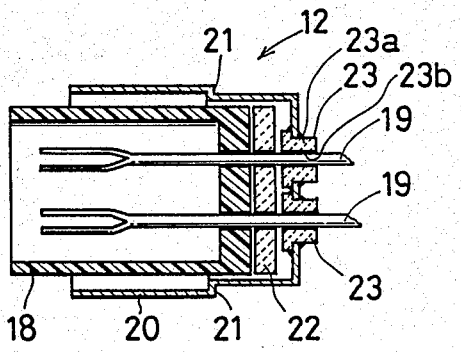
FIG. 4 is a longitudinal sectional view showing the female connector 12 forming another part of the filter connector device as shown in FIG. 1.

FIGS. 1 to 4 are views for illustrating an embodiment of the present invention. The filter connector device as shown in FIG. 1 is formed by combination of a male connector 11 as shown in FIG. 3 and a female connector 12 as shown in FIG. 4. The connectors 11 and 12 are engaged with each other to form a respective $\pi$-type filter as shown in FIG. 2 for each pair of connector pins which are connected in series with each other.

As shown in FIG. 3, the male connector 11 has a connector housing 13, and a plurality of connector pins 14 pass through the bottom wall of the connector housing 13. The connector pins 14 are bent in portions thereof outside the connector housing 13. A chassis 15 is provided to enclose the connector housing 13. A prescribed clearance is defined between the outer peripheral surface of the connector housing 13 and the chassis 15.

The male connector 11 has an inductor 16 and feedthrough capacitors 17 as elements for forming filter circuits. The inductor 16 is in the form of a plate as hereinafter described with reference to FIGS. 12 to 15, and is mounted within the chassis 15 and outside of the connector housing 13 by means of an adhesive agent (not shown) or the like. The feedthrough capacitors 17 are mounted in cooperation with respective ones of the connector pins 14. Each of the feedthrough capacitors 17 is substantially in the form of a stepped cylinder, which is provided with an outer peripheral electrode 17*a* on its outer periphery and an inner peripheral electrode 17*b* on its inner periphery. The outer peripheral electrode 17*a* is electrically connected to the chassis 15 and the inner peripheral electrode 17*b* is electrically connected to the connector pin 14 respectively by soldering or the like.

As shown in FIG. 4, the female connector 12 has a connector housing 18, and a plurality of connector pins 19 pass through the bottom wall of the connector housing 18. Each connector pin 19 of the female connector 12 is provided in its inward end with a clip for receiving a respective connector pin 14 of the male connector 11. A chassis 20 is provided to enclose the connector housing 18. The chassis 20 is provided with stepped portions 21 in upper and lower walls thereof to define a prescribed clearance between the same and the outer peripheral surface of the connector housing 18.

An inductor 22 and feedthrough capacitors 23 are assembled in the aforementioned female connector 12 as elements for forming filter circuits. The inductor 22 is in the form of a plate similarly to the aforementioned inductor 16, and is fixed to the outer side of the connector housing 18 by means of adhesive agent (not shown) or the like. Each of the feedthrough capacitors 23 is substantially in the form of a stepped cylinder similarly to the aforementioned capacitor 17, and is provided with an outer peripheral electrode 23*a* and an inner peripheral electrode 23*b*. The outer peripheral electrode 23*a* is electrically connected to the chassis 20 and the inner peripheral electrode 23*b* is electrically connected to the connector pin 19 by soldering or the like.

When the male connector 11 is engaged with the female connector 12 as shown in FIG. 1, the connector pins 14 and 19 are connected with each other. At this time, the connector housing 13 of the male connector 11 is inserted in the clearance between the outer peripheral surface of the connector housing 18 and the inner peripheral surface of the chassis 20, said clearance being defined by presence of the stepped portions 21 provided in the chassis 20 of the female connector 12, while the chassis 20 of the female connector 12 is press-fitted in the clearance defined between the outer peripheral surface of the connector housing 13 of the male connector 11 and the inner peripheral surface of the chassis 15. Thus, the chassis 15 and 20 are electrically connected with each other, so that the feedthrough capacitors 17 of the male connector 11 and the feedthrough capacitors 23 of the female connector 12 are commonly grounded. In order to secure the aforementioned electrical contact between the chassis 15 and 20, structure as shown in FIG. 5 may be employed.

Figure 5:
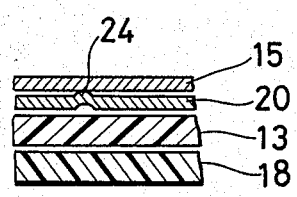
FIG. 5 is an enlarged sectional view showing a pregerted structure for the encircled part V of FIG. 1.

FIG. 5 is an enlarged sectional view showing an encircled part V of FIG. 1. In this example, an outwardly projecting part 24 is partially provided in the chassis 20 of the female connector 12. This projecting part 24 is reliably brought into contact with the inner surface of the chassis 15 of the male connector 11. Such a projecting part may alternatively be provided in the chassis 15 of the male connector 11. In other words, the chassis 15 may be provided with an inwardly projecting part, which is reliably brought into contact with the outer surface of the chassis 20.

When the male connector 11 is engaged with the female connector 12 as shown in FIG. 1, a $\pi$-type filter, whose equivalent circuit is shown in FIG. 2, is formed in relation to each pair of connector pins 14 and 19 which are connected in series with each other. Referring to FIG. 2, the circuit elements are indicated by numerals identical to those assigned to the corresponding elements in FIG. 1, in order to clarify the correspondence between the equivalent circuit diagram of FIG. 2 and the mechanical structural diagram of FIG. 1.

Figure 6:
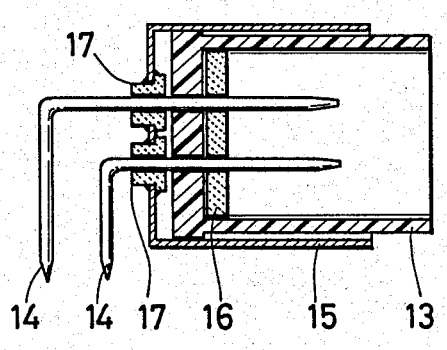
FIGS. 6 to 9 are longitudinal sectional views showing other examples of male connectors respectively.
Figure 9:
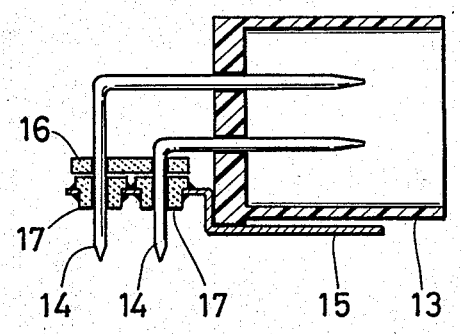

FIGS. 6 and 9 illustrate examples of male connectors which can be employed in place of the male connector 11 of the filter connector device as shown in FIG. 1. In these drawings, parts corresponding to those of FIG. 3 are indicated by similar reference numerals, in order to describe only characteristic structure.

In the male connector as shown in FIG. 6, an inductor 16 is mounted on the inner side of a connector housing 13 by an adhesive agent (not shown) or the like.

Figure 7:
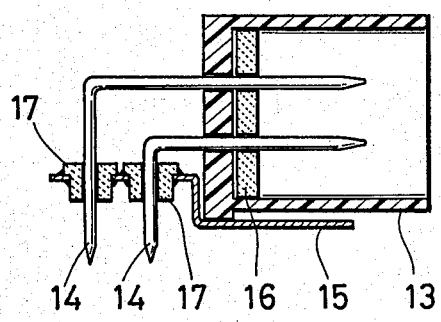

In the male connector as shown in FIG. 7, an inductor 16 is mounted on the inner side of a connector housing 13 similarly to the case of FIG. 6, while a chassis 15 outwardly extends from the bottom wall of the connector housing 13.

The connection pins 14 are bent as in FIG. 3, so that the chassis 15 will receive portions close to the outward ends of the bent connector pins 14, rather than portions of the connection pins 14 close to the connector housing 13 as in FIG. 3.

Feedthrough capacitors 17 are mounted on such an extending portion of the chassis 15, to receive the portions closer to the outward ends of the connector pins 14. The feedthrough capacitors 17 are provided in such positions to be closer to a printed circuit board (not shown) or the like on which the male connector is mounted.

Figure 8:
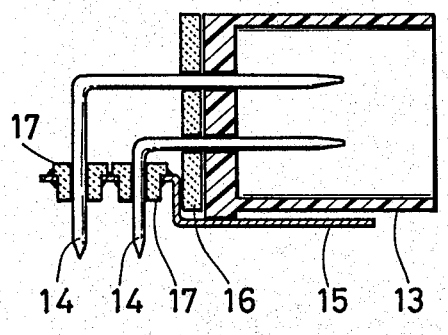

The male connector as shown in FIG. 8 is different from the male connector of FIG. 7 substantially merely in the position of an inductor 16. In the male connector of FIG. 8, the inductor 16 is mounted on the outer side of a connector housing 13 similarly to that of FIG. 3.

The male connector as shown in FIG. 9 is also different from that of FIG. 7 merely in the position of an inductor 16. In the male connector of FIG. 9, the inductor 16 is fixed in a position closer to feedthrough capacitors 17 by an adhesive agent (not shown) or the like.

Each of the male connectors as shown in FIGS. 6 to 9 may be combined with the female connector 12 as shown in FIG. 1 in place of the male connector 11, to form the $\pi$-type filter as shown in FIG. 2.

Figure 10:
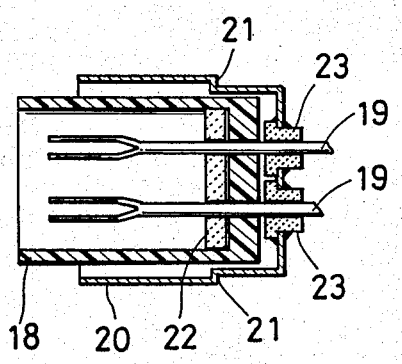
FIGS. 10 and 11 are longitudinal sectional views showing other examples of female connectors respectively.
Figure 11:
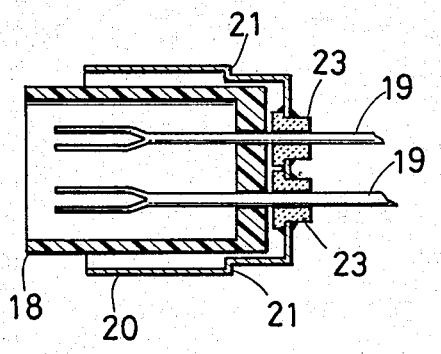
Figure 12:
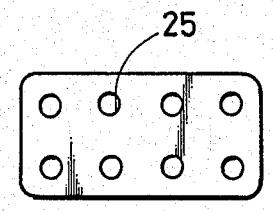
FIGS. 12 to 15 are front elevational views showing preferred configurations for the inductor 16 or 22.

FIGS. 10 and 11 illustrate examples of female connectors which can be employed in place of the female connector 12 of the filter connector device as shown in FIG. 1. Referring to FIGS. 10 and 11, parts corresponding to those of FIG. 4 are indicated by similar reference numerals, in order to describe only characteristic structure.

The female connector as shown in FIG. 10 is different from that of FIG. 4 in the position of an inductor 22. Referring tp FIG. 10, the inductor 22 is fixed to the inner side of a connector housing 18 by an adhesive agent (not shown) or the like.

The female connector as shown in FIG. 11 has no inductor, and only feedthrough capacitors 23 and a chassis 20 are mounted outside of a connector housing 18.

The female connector as shown in FIG. 10 or 11 may be combined with the male connector 11 as shown in FIG. 1 or that shown in any of FIGS. 6 to 9 to form the $\pi$-type filter circuit as shown in FIG. 2. Even if the female connector has no inductor as in the case of FIG. 11, the inductance component of the $\pi$-type filter circuit as shown in FIG. 2 can be provided by the inductor 16 provided in the male connector.

FIGS. 12 to 15 are illustrative of exemplary configurations of the inductor 16 or 22 employed in the male or female connector respectively.

The inductor 16 or 22 is formed of a plate of ferrite, which is provided with holes 25 for receiving the plurality of connector pins 14 and 19. Each of such holes 25 is preferably chamfered at an end of its inner peripheral wall to facilitate insertion of the connector pin 14 or 19.

Figure 13:
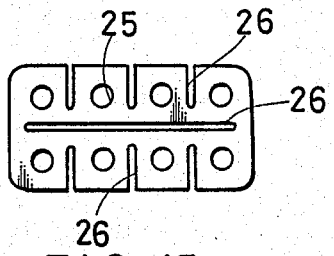
Figure 14:
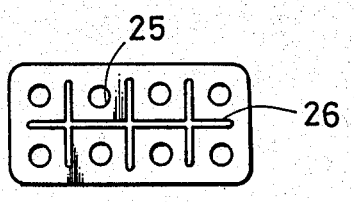
Figure 15:
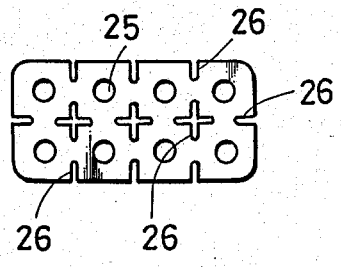

The inductors as shown in FIGS. 13, 14 and 15 are provided with slits 26 in different modes. These slits 26 are adapted to prevent interference between adjacent ones of the connector pins 14 or 19.

Although the inductor 16 or 22 is prepared as a single plate-shaped inductor employed in common for the plurality of connector pins 14 or 19 as shown in each of FIGS. 12 to 15, a plurality of inductors such as ferrite beads may alternatively be assembled, each inductor being employed in relation to a respective one of the connector pins.

While the male connector has been combined with the female connector to form only $\pi$-type filter circuits in the above description, the filter connector device according to the present invention may also be applied to form T-type or L-type filter circuits.

Figure 16:
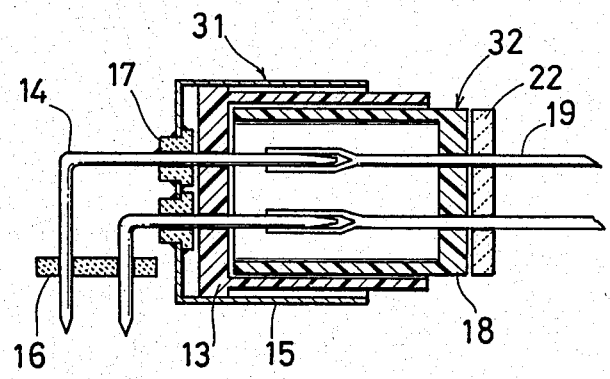
FIG. 16 is a longitudinal sectional view showing a filter connector device according to another embodiment of the present invention.
Figure 17:
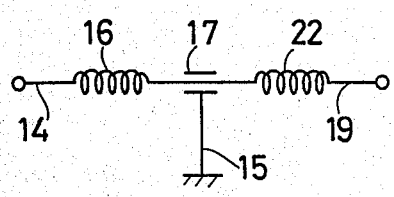
FIG. 17 illustrates a T-type filter circuit implemented by the filter connector device as shown in FIG. 16.
Figure 18:
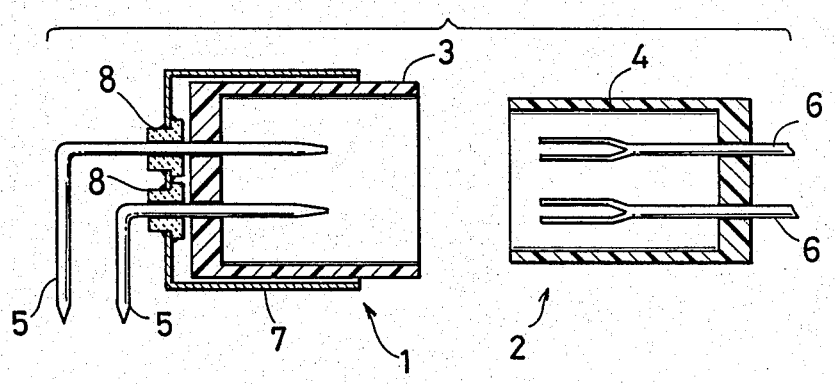
FIG. 18 PRIOR ART
FIG. 18 is a longitudinal sectional view separately showing a male connector 1 and a female connector 2 included in a conventional filter connector device.
Figure 19:
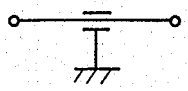
FIG. 19 PRIOR ART
FIG. 19 illustrates a filter circuit formed by the filter connector device as shown is FIG. 18.

FIG. 16 shows a filter connector device according to another embodiment of the present invention, which can form a T-type filter circuit as shown in FIG. 17.

The filter connector device as shown in FIG. 16 is formed by combination of a male connector 31 and a female connector 32. Both of the male and female connectors 31 and 32 include elements similar to those included in the male and female connectors 11 and 12 as shown in FIGS. 3 and 4, and hence these common elements are indicated by similar reference numerals.

In the male connector 31, the in positional relation between an inductor 16 and feedthrough capacitors 17, on connector pins 14, is reversed as compared with the male connector 11 of FIG. 3. In other words, the inductor 16 is mounted on the connector pins 14 in a position outside the feedthrough capacitors 17.

On the other hand, the female connector 32 has no elements corresponding to the chassis 20 and the feedthrough capacitors 23 as shown in FIG. 4.

The male and female connectors 31 and 32 are thus formed to obtain the T-type filter circuit as shown in FIG. 17 in relation to each pair of connector pins 14 and 19 which are connected in series with each other. Referring to FIG. 17, elements are indicated by reference numerals assigned to corresponding elements in FIG. 16, thereby to clarify correspondence between the equivalent circuit diagram of FIG. 17 and the mechanical structural diagram of FIG. 16.

The T-type filter circuit as shown in FIG. 17 can be implemented not only by the structure of FIG. 16 but also by other structure. The point is that the T-type filter circuit can be formed by inverting the positions where the feedthrough capacitor and the inductor are mounted on either the male connector or the female connector (as compared to the corresponding structures for forming the $\pi$-type filter circuit as hereinabove described with reference to FIGS. 1 to 15) and removing the feedthrough capacitors from the other connector.

Further, the embodiments for forming the $\pi$-type filter circuits can be modified to form L-type filter circuits. In this case, the feedthrough capacitors may be removed from either the male connector or the female connector.

Although examples of the present invention have been described and illustrated in detail, it is clearly understood that the same is by way of illustration and example only and is not to be taken by way of limitation, the spirit and scope of the present invention being limited only by the terms of the appended claims.

What is claimed is:

1. A filter connector device comprising in combination:

a male connector and a female connector detachably engaged with each other, said male connector and said female connector having a plurality of male connector pins and a corresponding plurality of female connector pins, respectively which are disposed therein to be connected in series with each other upon engagement of said male connector and said female connector;

a plurality of filter elements including at least one capacitor and at least one inductor, at least one of said filter elements being provided in said male connector and at least one in said female connector, each filter element being associated with the connector pins in its respective connector, said filter elements forming a filter circuit in cooperation with said corresponding male and female connector pins connected in series with each other upon engagement of said male connector and said female connector;

wherein each said inductor is in the form of a plate having a plurality of holes for receiving said plurality of connector pins in its respective connector, said inductor being associated with all of said plurality of connector pins in its respective connector; and wherein said inductor is provided with slits for preventing interference between adjacent ones of said plurality of connector pins in its respective said connector.

2. A filter connector device in accordance with claim 1, wherein said male and female connectors have:

male and female connector housings being provided in their interiors with respective inner ends of said male and female connector pins, and respective outer ends thereof passing outwardly through said connector housings; and male and female chassis, for receiving said male and female connector pins outside said male and female connector housings, respectively.

3. A filter connector device in accordance with claim 2, comprising at least two said capacitors, wherein each said capacitor is a feed-through capacitor substantially in the form of a stepped cylinder having outer and inner peripheral surfaces on which outer and inner peripheral electrodes are provided respectively, one said capacitor being arranged in a position where said male connector pin passes through said male chassis, and another said capacitor being arranged in a position where said female connector pin passes through said female chassis, with said outer peripheral electrode of each capacitor being electrically connected with said corresponding chassis, and said inner peripheral electrode of each capacitor being electrically connected with said corresponding connector pin.

4. A filter connector device in accordance with claim 2, wherein said male chassis and said female chassis are brought into contact with each other when said male connector and said female connector are connected with each other.

5. A filter connector device in accordance with claim 4, wherein said male chassis and said female chassis have surfaces, respectively, facing each other when said male connector and said female connector are connected with each other, one of said facing surfaces being provided with a part projecting toward the other said facing surface for engaging the same when said male and female connectors are connected.

6. A filter connector device in accordance with claim 3, wherein at least either said male connector pin or said female connector pin is bent in a portion outside the corresponding connector housing.

7. A filter connector device in accordance with claim 6, wherein said capacitor is positioned between said bent portion of said bent connector pin and said related connector housing.

8. A filter connector device in accordance with claim 6, wherein said capacitor is provided adjacent a portion of said bent connector pin outwardly of said bent position.

9. A filter connector device in accordance with claim 6, wherein said inductor is provided between said bent portion of said bent connector pin and said related connector housing.

10. A filter connector device in accordance with claim 6, wherein said inductor is provided adjacent a portion of said bent connector pin outwardly of said bent portion.

11. A filter connector device in accordance with claim 1, wherein a pair of said capacitors are each arranged to cooperate with a respective one of said male connector pin and said female connector pin.

12. A filter connector device in accordance with claim 1, wherein each of a pair of said capacitors and each of a corresponding pair of said inductors are arranged to cooperate with a respective one of said male connector pin and said female connector pin.

13. A filter connector device in accordance with claim 1, wherein a pair of said inductors are each arranged to cooperate with a respective one of said male connector pin and said female connector pin.

* * * * *